US005217301A

United States Patent [19]

Munz et al.

[11] Patent Number: 5,217,301

[45] Date of Patent: Jun. 8, 1993

[54] LIGHTING FIXTURE HAVING AN UNOBTRUSIVE SURFACE SWITCH

[75] Inventors: Willi Munz, San Francisco; Douglas J. Herst, Ross, both of Calif.

[73] Assignee: Peerless Lighting Corporation, Berkeley, Calif.

[21] Appl. No.: 898,102

[22] Filed: Jun. 10, 1992

Related U.S. Application Data

[63] Continuation-in-part of Ser. No. 714,145, Jun. 11, 1991.

[51] Int. Cl.[5] ..... H01H 21/24

[52] U.S. Cl. ..... 362/394; 200/547; 200/573

[58] Field of Search ..... 200/547, 548, 573; 362/394, 251

[56] References Cited

U.S. PATENT DOCUMENTS 1,802,712 4/1931 Graubner ..... 200/548

5,112,627 6/1992 Trana ..... 200/547

*Primary Examiner*—Carroll B. Dority

*Attorney, Agent, or Firm*—Donald L. Beeson

[57] ABSTRACT

A lighting fixture is comprised of a housing fabricated in two mating sections which are joined in a manner that produces a reveal in the bottom exterior surface of the housing. A switch, and preferably a slide switch, is mounted to the interior side of the housing such that the switch actuation member, preferably a slide member, projects through a reveal slot so as to accessibly, but unobtrusively, project from the housing's reveal. The switch preferably has multiple operative states corresponding to the different slide positions of the switch's slide member within the reveal.

9 Claims, 5 Drawing Sheets

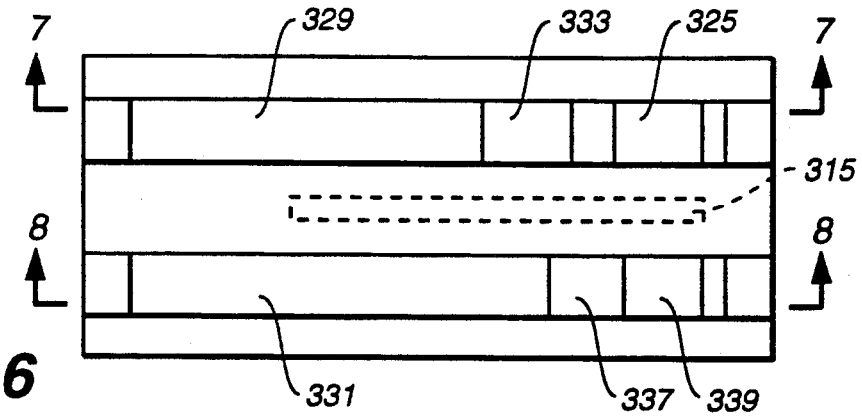
FIG._6
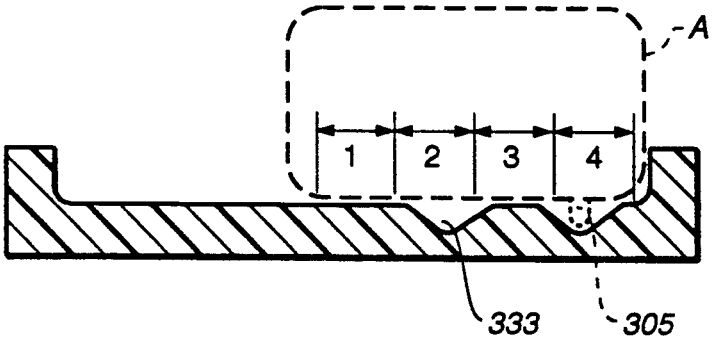
FIG._7
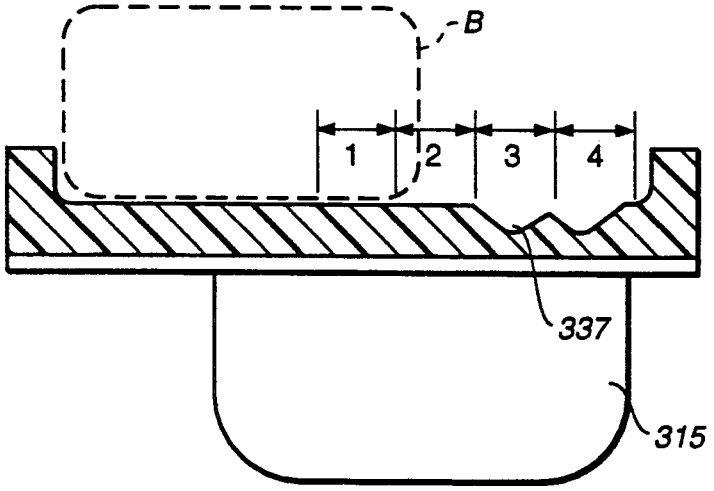
FIG._8
| POSITION | SWITCH A | SWITCH B |
|---|---|---|
| 1 | ON | ON |
| 2 | OFF | ON |
| 3 | ON | OFF |
| 4 | OFF | OFF |
FIG._9

LIGHTING FIXTURE HAVING AN UNOBTRUSIVE SURFACE SWITCH

CROSS-REFERENCE TO RELATED APPLICATIONS

This is a continuation-in-part of application Ser. No. 07/714,145 filed Jun. 11, 1991.

BACKGROUND OF THE INVENTION

The present invention generally relates to the field of lighting, and more particularly to lighting switches for switching lighting fixtures on and off and between other operative states. The invention has particular applicability to furniture integrated ambient lighting, that is, ambient lighting fixtures adapted for use on modular furniture systems for the office environment.

The most familiar approach to controlling ambient lighting in an office or in other interior environments is through the use of a wall switch to which the ambient lighting fixtures are remotely wired. A variety of wall switches have been employed in different switching schemes which include the ability to switch ambient lighting fixtures between operative states, such as providing one switch for turning on some, but not all of the lamps of the fixture where lower illumination levels are desired, and another switch for turning on the remaining lamps of the fixture where it is desired to increase the level of ambient lighting.

The present invention relates to the desirability, in certain ambient lighting installations and particularly in installations where the lighting fixtures are mounted within reach, such as by mounting them near eye level directly or next to office furniture systems, of placing the switch for activating the lighting fixture directly on the fixture itself. Switches directly mounted to office lighting fixtures for individually switching the fixture are commonly encountered on task lights, for example, under-the-counter task light, but not ambient lights. A disadvantage of such fixture mounted switches on ambient lights, assuming they are reachable, is that the switch can be obtrusive and unsightly on a fixture which is otherwise designed to be an aesthetically pleasing architectural element within an interior space.

The present invention involves a luminaire having an unobtrusive surface switch which is readily accessible, easily operated, capable of switching between multiple operative states of the fixture, and which is within view, and yet blends in with the lines of the fixture housing. The invention generally overcomes the difficulty of locating a switch on observable surfaces of a fixture housing in such a manner that the switch does not detract from the overall appearance of the fixture.

SUMMARY OF THE INVENTION

Briefly, the invention is directed to a lighting fixture, suitably an indirect fixture, having a fixture housing which is constructed in two sections, referred to herein as first and second sections, joined along mating edges in such a way that a recess or "reveal" is created along the mating edges of the housing. An electrical switch means for switching the fixture's light source is mounted to the interior surface of the housing directly behind the reveal. This switch means includes a switch actuation member, a portion of which extends through a reveal slot so as to accessibly project from the exterior of the luminaire housing from within the reveal. In the preferred embodiment, the switch actuation member is a slide member having a thin accessibly projecting slide tab. Because of the reveal construction of the housing and the location of the switch, the slide tab, while observable and therefore accessible, tends to blend into the reveal and be complimentary to the linear aspect of the reveal.

Preferably, the electrical switch means of the invention is comprised of at least one micro switch, such as a Honeywell V3 Series miniature switch, activated by a plunger element which follows the movement of an cam surface on the slide member. Actuating the electrical switch means is thus simply a matter of moving the slide tab in a slide motion within the reveal. Where it is desired to switch between multiple operative states, such as selectively switching separate lamps within a fixture housing, two side-by-side micro switches and two corresponding cam surfaces on the slide element can be provided.

It is therefore understood that a primary object of the present invention is to provide an accessible, unobtrusive switching element on the exterior surface of a lighting fixture of the type used for ambient lighting. It is a further object of the invention to provide a switching element that is easily operated and has a capability of switching between two or more operative states of the luminaire. Yet other objects of the invention will be apparent from the following specification claims.

DESCRIPTION OF THE DRAWINGS

FIG. 6 is a top plan view of the slide member of the surface mounted switch of the invention.

FIG. 7 is a cross-sectional view in side elevation of the base of the slide member shown in FIG. 7 with a phantom line representation of the micro switch thereon.

FIG. 8 is a cross-sectional view in side elevation of the slide member of FIG. 7 with a phantom representation of the micro switch thereon in a different position than shown in FIG. 8.

FIG. 9 is a truth table showing four different operative states of the switches shown in FIGS. 8 and 9 which depend on the position of the slide member.

DETAILED DESCRIPTION OF THE ILLUSTRATED EMBODIMENT

Figure 1:
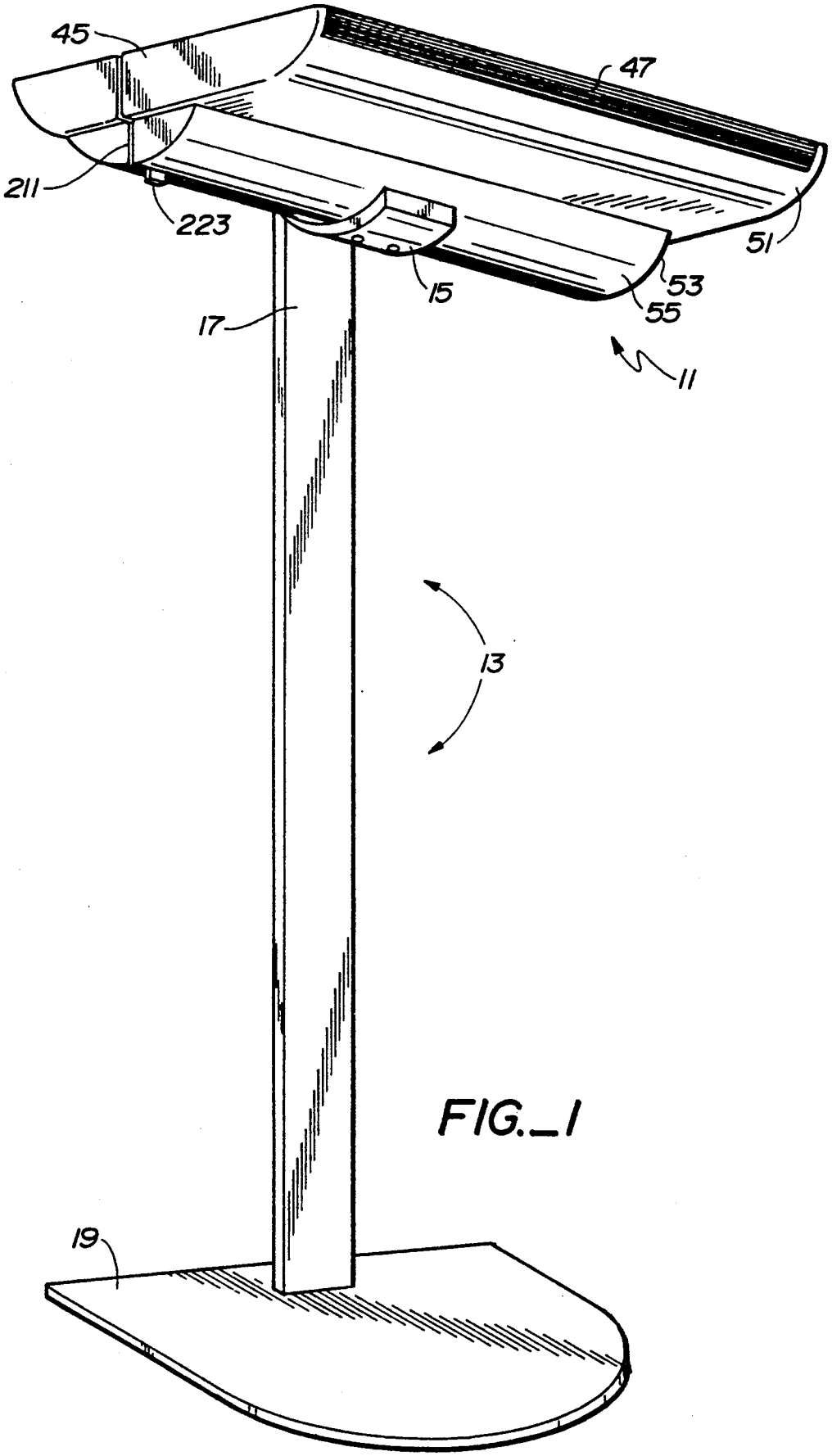
FIG. 1 is a bottom perspective view of a floor mounted ambient lighting fixture having a surface mounted switch according to the invention.

Referring now to the drawings, FIG. 1 shows a lighting fixture 11 attachably supported by a mounting structure 13 which includes a yoke 15, upright stem 17, and support stand 19. The mounting structure of FIG. 1 is illustrative only, it being understood that the fixture could be interchangeably mounted in an accessible location to a variety of structures, for example, partition walls or binder bins of a modular office furniture system. Generally, the fixture heads will be mounted at or above eye level and within the reach of a person of average height.

Fixture 11 has a generally pan-shaped opaque housing 45 of a characteristic rectangular geometry. A visible side lens 47 extends along the top of the housing side wall 51 to provide a low brightness element visible to employees within an open office space. The housing also includes a channel portion 53 which protrudes from and longitudinally extends along the bottom of the housing to provide a bottom support surface 55 by which the fixture is supported on the yoke 15 of the mounting structure 13. As can be seen in FIG. 1, both the yoke and the bottom surface of the fixture's channel portion have corresponding curved shapes such that they nest together when the fixture engages the yoke.

Figure 2:
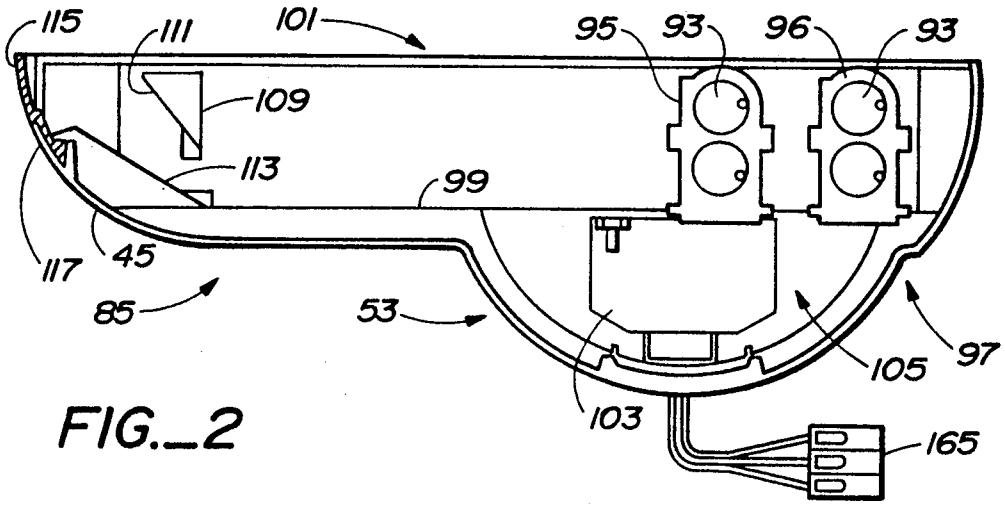
FIG. 2 is a cross-sectional side elevational view of the lighting fixture shown in FIG. 1 and FIG. 3 taken along section lines 2—2 in FIG. 3.

Referring to FIG. 2, fixture housing 45 is seen to contain a light source in the form of two high intensity discharge lamps 93, suitably General Electric Biax lamps, plugged into two closely adjacent lamp sockets 95, 96 mounted near the short side 97 of the housing which, as can be seen, is asymmetric. The fixture housing further contains a lamp ballast 103 and a bottom reflector 99 which extends over the width of the housing to reflect source light up through the housing's top opening 101. The ballast and lamp sockets are both physically attached to the reflector so that the reflector, ballast, and lamp sockets form an easily installable subassembly, with the ballast being secured to the underside of this subassembly so that it extends down into the bottom cavity 105 formed by the housing bottom channel 107. The ballast wiring extends through this bottom channel for connection to wiring fed through suitable wire chases in the stem and yoke of the fixture support structure. On-site assembly of the fixture head is facilitated by the use of a quick connector 165 at the ends of the ballast wiring; the quick connector connects with a corresponding quick connector in the yoke 87. It shall be understood that any suitable ground can be provided in the yoke or elsewhere within the support structure.

The fixture housing 45 also contains a secondary reflector 109 having a diffuse reflector surface 111 which, in conjunction with the angle side reflector portion 113 of the bottom reflector, provides an indirect light path between the lamps 93 and the visible side element 119 mounted to the top of the housing side wall 117. A secondary reflector structure, which extends the full length of the housing and which shields this side lens element from receiving light directly from the light source, permits greater control over the level and uniformity of the brightness induced in the side lens by the light source.

Figure 3:
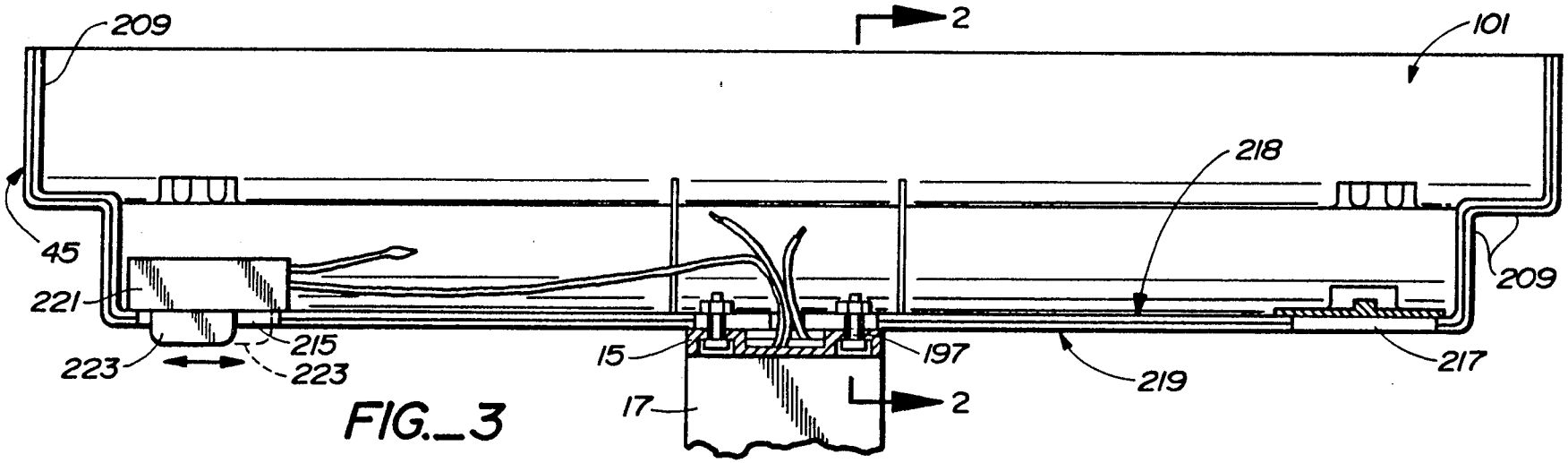
FIG. 3 is a cross-sectional front elevational view of the lighting fixture shown in FIGS. 1 and 2 showing the attachment of the fixture to the yoke and stem of the fixture's mounting structure, and further showing the wiring of the surface mounted switch of the invention.
Figure 4:
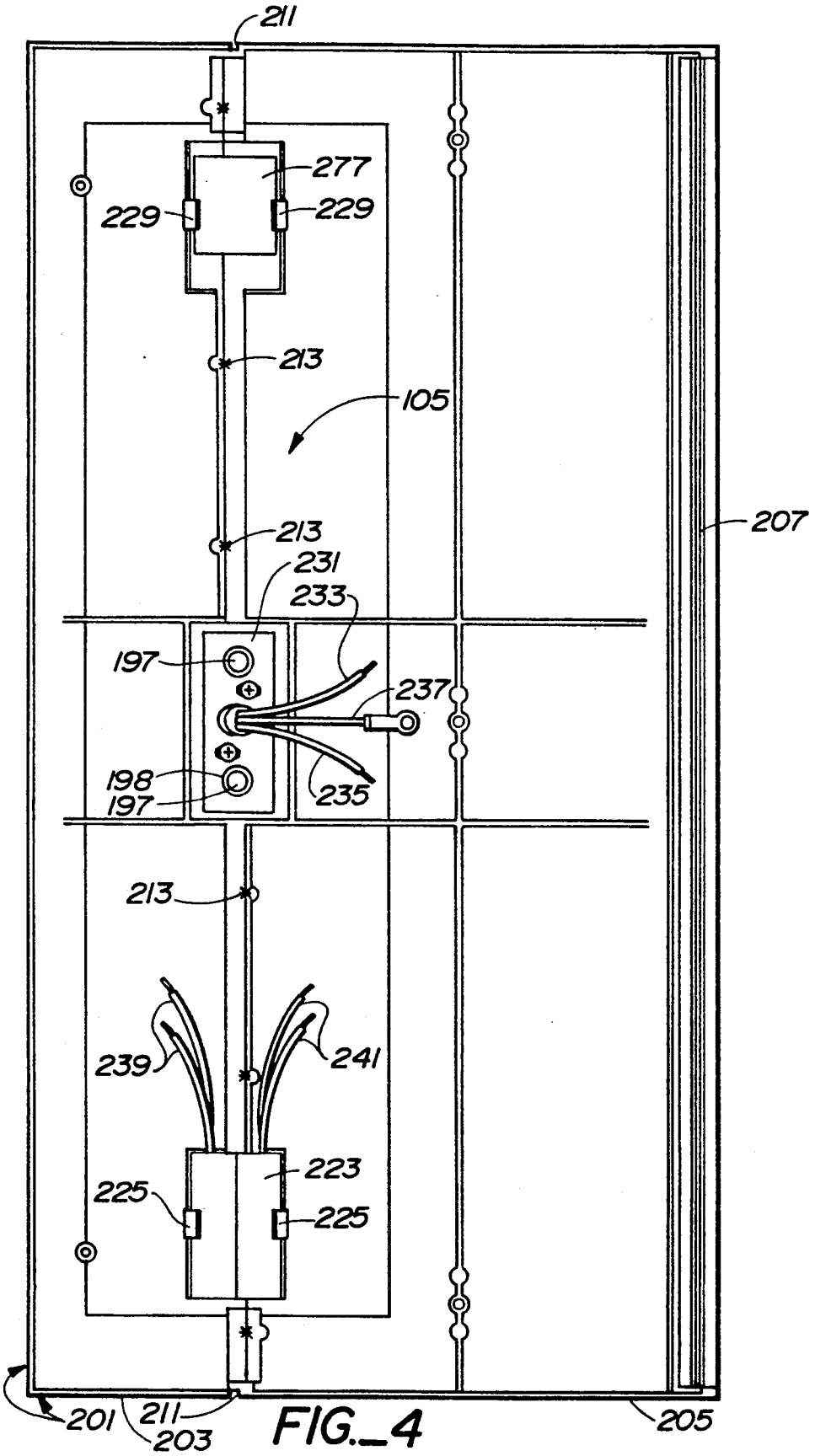
FIG. 4 is a top plan view of the fixture head shown in FIG. 2 with the reflector and lamps removed.

FIGS. 3 and 4 best illustrate the construction of the housing, the internal slide switch 221 of the invention, and the wiring of the housing ballast and slide switch. With reference to these figures, the housing 45 has an interior side 218 and an exterior side 219 and is seen to be fabricated from a first housing section 203 and a second housing section 205, with the second housing section which supports the side lens element 207 having a wider dimension than the first housing section. The two sections are joined along identical mating interior stepped edges 209 which are formed to produce a reveal 211 on the housing's exterior side along the entire visible portion of the joined edges. (FIG. 1 shows the reveal at the end of the housing.) Such a reveal construction permits the first and second sections of the housing to be joined together, such as by tack welds 213 shown in FIG. 4, such that otherwise apparent and unsightly mismatches at the abutting edges of the housing will be hidden from view.

The present invention takes unique advantage of this reveal construction by providing an electrical switch means in the form of slide switch 221 having a thin slide tab 223 that unobtrusively and accessibly projects from the reveal. The switch's slide tab is accommodated in the reveal by means slide switch slot 215, which is one of two available slide switch slots 215, 217 located at either end of the housing. Slide switch 221, which is mounted to the interior side of the housing, is held in place behind its slide switch slot 215 by spring clips 225 which grip onto raised ribs formed on the housing. The unused slot 227 is covered by a blanking plate 227 which is similarly held in place by spring clips 229. The second slide switch slot is provided so that each fixture section is symmetrical along its mating edge 209 so that two identical large housing sections can be joined to produce a symmetrical fixture.

FIGS. 3 and 4 also generally show the manner of wiring the slide switch 221. Specifically, a three-wire cord having positive and negative wires 233, 235 and ground wire 237, extend through a wire hole in a bottom mounting plate 231 in the center of the housing. It is seen that the bottom mounting plate also receives the head attachment screws 197 which are secured by nuts 198 for attaching the fixture head to the yoke 17. A would be readily apparent to a person skilled in the art, the slide switch would be wired in series with the ballast and lamp sockets forming part of the reflector subassembly.

Figure 5:
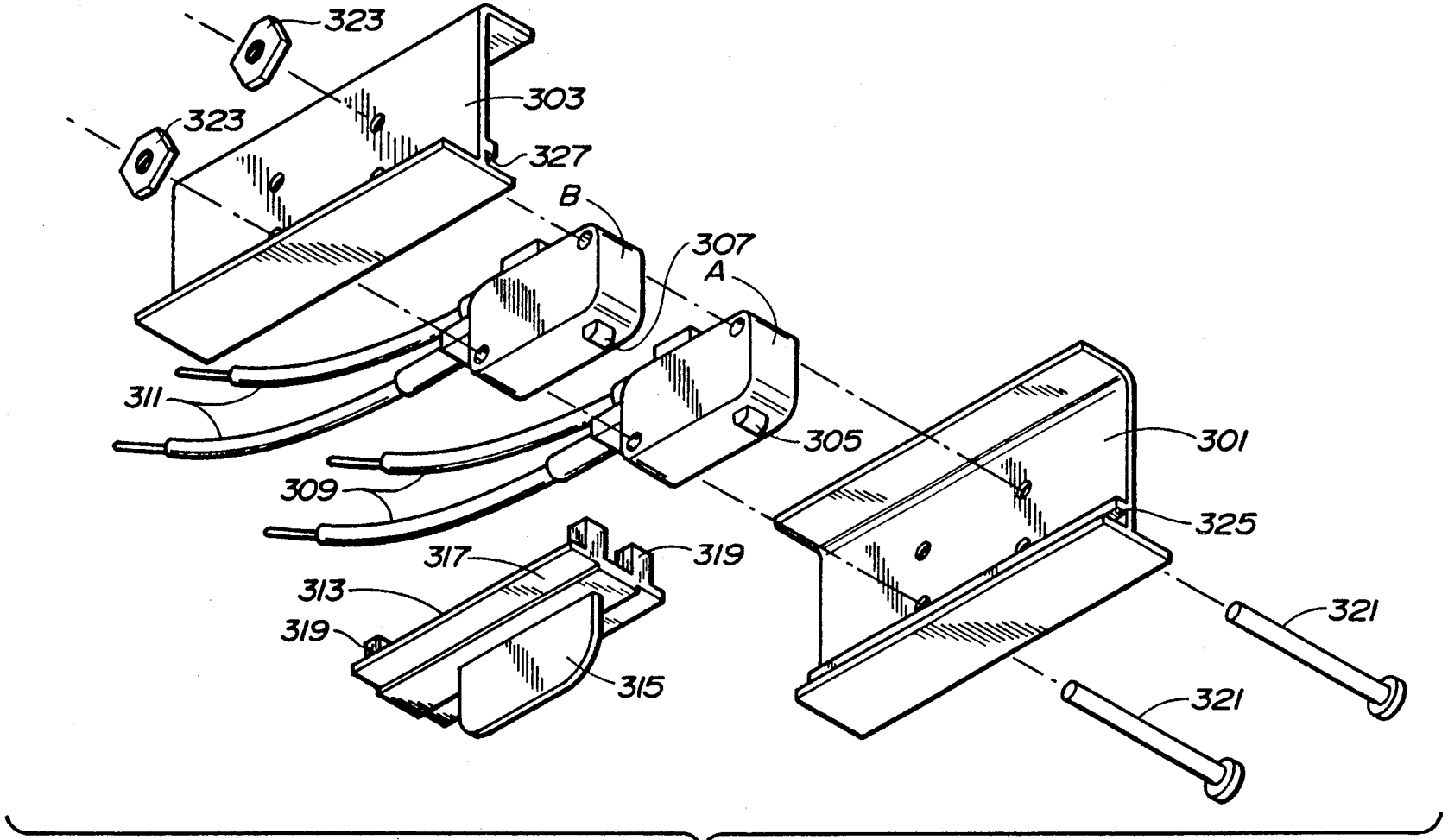
FIG. 5 is an assembly drawing showing the assembly of the surface mounted switch of the invention.

FIGS. 5 and 6 show the slide switch of the invention in greater detail and in a version where two micro switches are used for switching between four operative states of the fixture, that is, for switching the fixture to an off state, to a state where both lamps are on, and to states where only one of the fixture lamps are on.

Referring to FIG. 5, a slide switch assembly includes switch housing side plates 301, 303, micro switches denoted A and B having, respectively, plungers 305, 307 and lead wires 309, 311. The switch assembly also includes a switch actuation member in the form of slide member 313 which has an elongated, thin slide tab 315 extending from a base portion 317 having stops 319. As generally illustrated by the assembly drawing of FIG. 5, the dual micro switches A and B are sandwiched between the switch housing side plates, with the assembly being secured by means of screws 321 and nuts 323 which extend through retention screw holes in both the housing side plates and the micro switches. The slide member is slidably held over the micro switches by fitting the extended edge portions of the slide member's base 317 into opposed guide slots 325, 326 formed in the top of the housing side plates.

As illustrated in FIGS. 6–8, the bottom of the base portion 317 of slide member 313 has two cam surfaces 329, 331 for each of the micro switches A and B of the slide switch assembly. Each of the cam surfaces have depressions and raised areas positioned along the length of the cam surface for depressing and allowing the extension of the plunger of its corresponding micro switch. As best illustrated in FIG. 7 showing a phantom line representation of micro switch A, the micro switch is turned "on" when the plunger 305 passes over a raised area and turned "off" when the plunger passes over one of the depressions in the cam surface. Thus, it can be seen that a sliding movement of the slide member 317 of the slide switch 221 causes the micro switch plungers to pass over cam surfaces 329 and 331 to cause the lamps of the fixture to turn on and off.

Each of the micro switches A and B individually switch one of two separate lamps within the fixture housing, such as one of the two lamps 93 shown in FIG. 2. The four possibilities for switching these lamps is to switch both lamps off, both lamps on, one lamp on and one lamp off, and the reversing of the on lamp to the off lamp and off lamp to the on lamp. A truth table for these four operative states corresponding to the four depicted positions of the slide switch in FIGS. 7 and 8 is shown in FIG. 9. Referring to FIGS. 7 and 8, it can be seen that the depicted switch position "1" corresponds to a raised area on both of the cam surfaces 329, 331; position "2" corresponds to depression 333 on cam surface 329 and a raised area on cam area 331; position "3" corresponds to a raised area on cam surface 329 and depression 337 on cam surface 331; and position "4" corresponds to depression 335 on cam surface 329 and depression 339 on cam surface 331.

It can therefore be seen that the present invention provides an easily installed, versatile slide switch unobtrusively installed within the reveal of a lighting fixture housing. Although the illustrated embodiment of the invention has been described in considerable detail in the foregoing specification, it is understood that it is not intended that the invention be limited to such detail, except as necessitated by the following claims.

We claim:

1. A lighting fixture having an unobtrusive surface switch comprising a housing having an interior side and an exterior side, first and second sections having mating edges along which said sections are joined, a reveal in the exterior surface of said housing at said mating edges, and a reveal slot extending through said housing along a portion of said reveal, a light source in said housing, and electrical switch means for switching said light source, said switch means being mounted to the interior side of said housing proximate said reveal slot and having a switch actuation member which projects through said reveal slot so as to accessibly project from the exterior side of said housing from within said reveal.

2. The lighting fixture of claim 1 wherein said reveal is formed in a bottom wall portion of said housing such that said switch actuation member is accessible from below said lighting fixture.

3. The lighting fixture of claim wherein said switch actuation member is a slide member for slidably actuating said electrical switch means, and wherein said slide member includes a slide tab which extends through said reveal slot so that it accessibly projects from and is slidable within said reveal.

4. The lighting fixture of claim 3 wherein said electrical switch means includes a depressible plunger element for switching said switch means, and wherein said slide member has a cam surface for depressing said plunger element at predetermined slide positions of said slide tab.

5. The lighting fixture of claim 4 wherein said light source has multiple operative states and said electrical switch means includes at least two plunger elements for switching between the multiple operative states of said light source, and wherein said slide member has a cam surface for each of said plunger elements for depressing said plunger elements in a predetermined sequence in accordance with the slide position of said slide member such that the slide position of said slide member in said reveal will determine which of the light source's operative states is active.

6. The lighting fixture of claim 5 wherein said light source includes two separate lamps and wherein the two plunger elements switch between the following operative states: both lamps off, one lamp on and one lamp off, and both lamps on.

7. The lighting fixture of claim 1 wherein said housing has at least two reveal slots for accommodating said electrical switch means at different locations along said reveal.

8. The lighting fixture of claim 7 wherein said reveal slots are symmetrically disposed along said reveal.

9. A lighting fixture having an unobtrusive surface switch comprising a housing having an interior side and an exterior side, first and second sections having mating edges along which said sections are joined, a reveal in the exterior side of said housing at said mating edges, and a reveal slot extending through said housing along a portion of said reveal, a light source in said housing comprised of two separate lamps, and electrical switch means for switching said light source, said switch means being mounted to the interior side of said housing behind said reveal slot and having at least two plunger elements for switching between the multiple operative states of the two lamps of said light source, said electrical switch means having a slide member for slidably actuating said electrical switch means, said slide member including a slide tab which extends through said reveal slot so that it accessibly projects from and is slidable within said reveal and a cam surface for each of said plunger elements for depressing said plunger elements in a predetermined sequence in accordance with the slide position of said slide member such that the slide position of said slide member in said reveal will determine which of the light source's operative states is active.

* * * * *